United States Patent [19]

Watt

[11] Patent Number: 4,513,583

[45] Date of Patent: Apr. 30, 1985

[54] AIR COOLED ICE RINK CONSTRUCTION

[76] Inventor: Allan E. Watt, 414 Montgomery Ave., Riverview, New Brunswick, Canada, E1B 1Z8

[21] Appl. No.: 501,247

[22] Filed: Jun. 6, 1983

[30] Foreign Application Priority Data

Jul. 26, 1982 [CA] Canada ..... 408052

[51] Int. Cl.[3] ..... A63C 19/10

[52] U.S. Cl. ..... 62/235; 62/412

[58] Field of Search ..... 62/235, 412

[56] References Cited

U.S. PATENT DOCUMENTS

| | | | |
|---|---|---|---|
| 632,035 | 8/1899 | Anderson | 62/235 |
| 1,053,443 | 2/1913 | Scott | 62/235 |
| 3,641,782 | 2/1972 | Timms | 62/235 |
| 3,658,124 | 4/1972 | Tippmann | 62/235 |
| 4,023,947 | 5/1977 | Ferry | 62/412 |

FOREIGN PATENT DOCUMENTS

| | | | |
|---|---|---|---|
| 922526 | 3/1973 | Canada | 62/9 |
| 1314 | of 1911 | United Kingdom | 62/235 |

*Primary Examiner*—Ronald C. Capossela

*Attorney, Agent, or Firm*—Henry Sternberg; Norbert P. Holler

[57] ABSTRACT

The subject invention is an air cooled ice rink construction in which the means for cooling the slab of the ice rink is separated from the ground under the slab by a region accessible to air external to the ice rink enclosure. The means for cooling the slab of the ice rink may be a circulating flow of mechanically-cooled air or, if the air external to the ice rink enclosure is sufficiently cool, it may be a circulating flow of such external air. The ice rinks constructed according to the subject invention may be operated at significantly lower operating costs than conventional ice rinks.

7 Claims, 5 Drawing Figures

POWER CONSUMPTION PER MONTH
(ARENA OPERATING OCTOBER TO APRIL ANNUALLY)

AIR COOLED ICE RINK CONSTRUCTION

This invention relates to an ice rink cooling system, and more particularly, to a cooling system utilizing circulated cold air.

The conventional type of artificial cooling for enclosed ice rinks generally comprises an array of cooling coils encased within the concrete slab of the ice rink. A brine solution is circulated through the coils, heat being continuously removed from the brine solution by heat exchange with the Freon TM or ammonia of the refrigeration plant. If extended end-to-end, the pipes of the cooling coils would be several miles in length. The slab of most conventional ice rinks is maintained at approximately 18° F.; it has been found that this temperature represents an optimum compromise between the power consumed by the refrigeration plant and the maintenance of a suitable ice quality.

An underlay of insulation may exist in the cavity between the ice rink slab and the underlying ground, either occupying the whole of such cavity or an upper or lower portion only of such cavity. Such insulation, whether it partially or fully fills the cavity under the ice rink slab, has little effect on the amount of heat drawn by the ice rink slab from the ground. If an air cavity exists between the ice rink slab and the underlying ground such cavity is isolated from the ambient temperature conditions of air external of the ice rink enclosure (such air being sometimes referred to henceforth as "ambient external air"); in fact, the ice rink slab may be supported above the ground by supports which partition the space under the ice rink slab into a series of small cavities all isolated from each other as well as from the ambient temperature conditions of air external to the ice rink enclosure. The effect of such ice rink construction is that the presence of the insulation only retards rather than stops heat loss from the ground to the ice rink slab.

Artificial ice rinks usually become operational in early autumn when the ground temperature underlying the ice rink is 40° F. to 50° F. A significant portion, i.e. 5% to 10%, of the power consumed by the refrigeration plant of the ice rink will be utilized to draw heat from the ground. Similarly, in the late spring months up till the time when ice activities on the ice rink are discontinued - the ground underlying the ice rink is maintained in a frozen state due to cooling of the ice rink slab. Not only is the maintenance of the ground in a frozen state a consumption of a significant proportion of the refrigeration plant output, but also the ground may take two or three months to thaw after cooling of the ice rink slab is discontinued, the ice rink enclosure being maintained at an abnormally low temperature during such time by such thawing.

The subject invention is a means for cooling an ice rink that has the advantages of both simplicity and lower operating costs over the cooling means utilized in a conventional ice rink construction such as that described in the foregoing paragraphs.

The ice rink construction of the subject invention has a further advantage over those conventional ice rinks that are constructed with the slab resting directly on the ground (as opposed to being supported off the ground). The further advantage is that the subject invention virtually eliminates "slab failure" due to settlement or frost heave. Slab failure refers to cracking of a slab resulting from localized stresses on the slab due to shifting of the ground on which it directly rests. Brine pipe breakage and leakage usually accompany slab failure, and the cost of repairing or replacing an ice rink slab are considerable. In one eastern region of Canada slab failure is present to some degree in more than 50% of the ice rinks in which the slab rests directly on the ground. As will become evident, slab failure would be almost impossible with the ice rink construction of the subject invention.

A still further advantage of the ice rink construction of the subject invention relates to the significantly faster rate at which ice may be cooled compared to that possible in a conventional ice rink construction. The ice temperature in all ice rinks is normally allowed to rise to approximately 28° F. during the periods that the ice rink structure is unoccupied. The ice rink construction of the subject invention can cool ice from such temperature to a temperature suitable for skating (normally, approximately 18° F.) at a significantly faster rate than is possible with a conventional ice rink construction. In localities where off-peak reduced electrical rates are applicable, such faster ice cooling ability may provide the subject invention with an even greater economic advantage over conventional systems.

In its most basic form, the subject invention is an ice rink construction comprising a floor adapted to support ice thereon, and a cooling means adapted to cool the floor. The cooling means is supported off the ground such that ambient external air has access to the region between the cooling means and the ground and insulation extends between the cooling means and such region.

In another form, the subject invention is an ice rink construction comprising a floor adapted to support ice thereon, a chamber extending under the floor such that the floor defines an upper surface of the chamber, all surfaces of the chamber except the upper surface being insulated against heat transfer, and means adapted to circulate cold air through the chamber at a rate sufficient to maintain freezing of ice on the floor. The ice rink construction of the subject invention is also defined by the chamber being supported off the ground such that ambient external air has access to the region under the chamber.

Canadian Pat. No. 922,526 relates to an air-cooled artificial ice rink in which cooled air is circulated through the hollow space between the ice supporting surface of an ice rink and the ground thereunder. The ice supporting surface is supported above the ground such that a single cavity extends under the whole ice supporting surface. Air circulates generally through the hollow space and through the cooling coil of a refrigeration unit positioned under the ice supporting surface. Along the sides and ends of the ice rink of that reference insulation is piled such that heat cannot enter the hollow space from the external ambient air. The ice rink construction of the reference has the drawback of conventional brine-Freon ice rink cooling plants in that heat is drawn from the ground under the ice rink by the cooling medium. The subject invention differs from such ice rink cooling means by allowing ambient external air access to the region under the cooling means, such region being separated from the cooling means by insulation. Thus, the ice rink slab of the subject invention draws heat from the ice but not from the ground; the ground is exposed to ambient external air conditions.

An advantage of the ice rink cooling means of the subject invention is that ambient external air, when sufficiently low in temperature, can be circulated through the chamber under the ice rink slab. A control means selectively controls whether ambient external air is circulated through that chamber or whether air cooled by the refrigeration unit is recirculated through the chamber. The control means is connected to a sensor exposed to the ambient external air conditions. The air circulates through a circulating flow channel comprising the chamber and an insulated duct means having one end connected to one end of the chamber and another end connected to another end of the chamber. A fan means circulates the air through the circulating flow channel. A cooling means in the circulating flow channel is operable to remove heat from the air being circulated through that channel.

Ambient external air is introduced into and expelled from the circulating flow channel by means of a pair of dampers spaced from each other along that channel. The means for selectively controlling whether ambient external air is circulated through the circulating flow channel operates the pair of dampers and also operates a further damper positioned in the circulating flow channel intermediate of the pair of dampers.

The invention will now be more fully described by means of a preferred embodiment utilizing the accompanying drawings in which.

Figure 1:
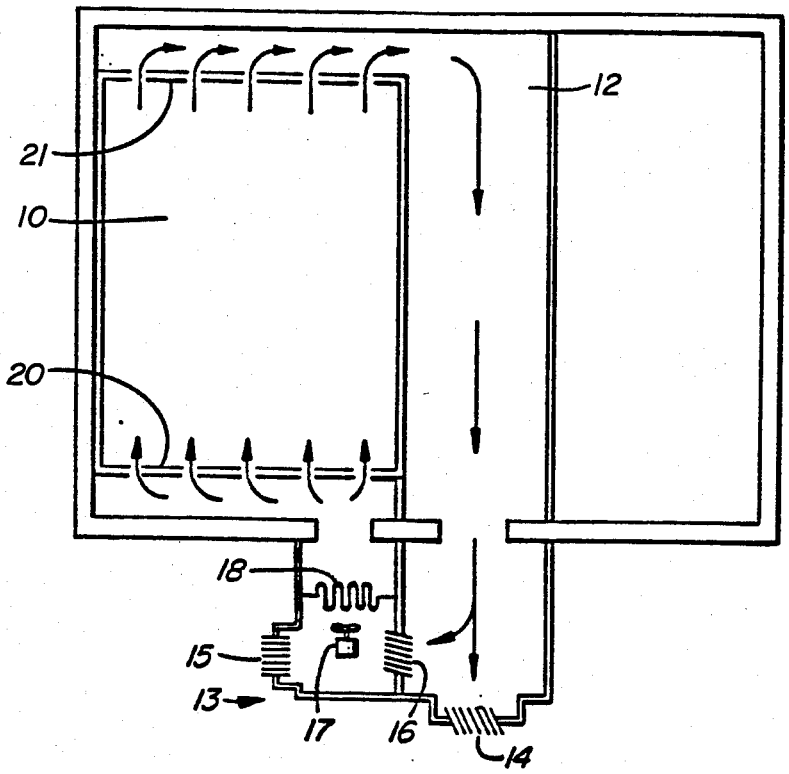
FIG. 1 is a cross-sectional plan view of an ice rink constructed according to the subject invention, the cross-section being through a plane immediately below the ice rink bed.
Figure 2:
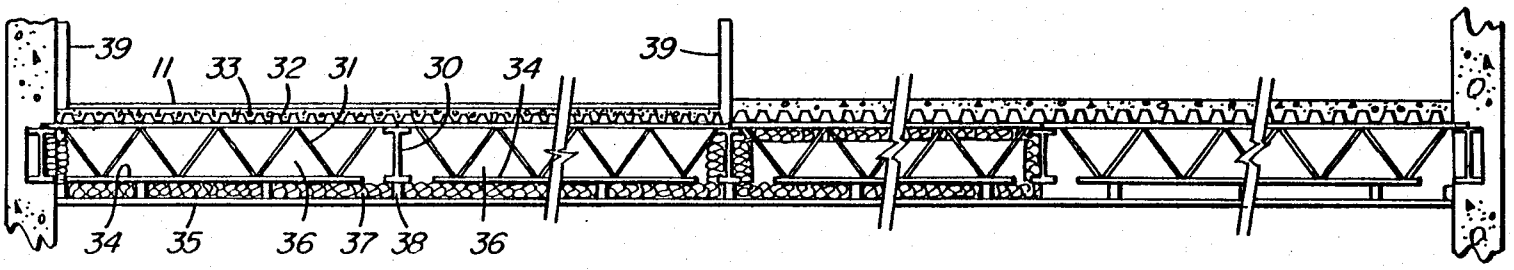
FIG. 2 is a cross-sectional end view of one embodiment of an ice rink construction of the subject invention.
Figure 3:
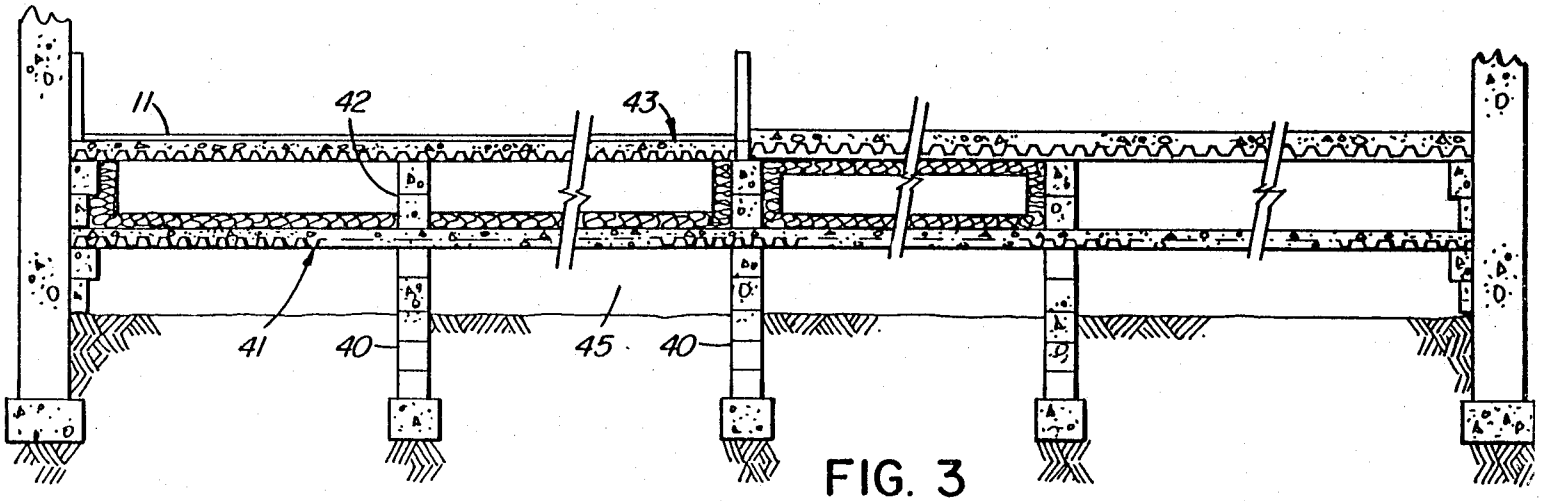
FIG. 3 is a cross-sectional end view of a second embodiment of an ice rink construction of the subject invention.

In the cross-sectional plan view of FIG. 1 the chamber under the slab of the ice rink is designated as 10. The upper surface of the chamber 10 is the ice rink slab 11, two embodiments of which are shown in FIGS. 2 and 3 and will be more fully described later. Chamber 10 comprises a portion of the circulating flow channel of the subject invention. The other parts of the circulating flow channel are insulated duct 12 and the ducts within refrigeration plant 13. Refrigeration plant 13 receives air flowing out of insulated duct 12 and cools that air before sending it back into chamber 10. Alternately and depending upon the ambient external air temperature, the air leaving insulated duct 12 may be directed out of the circulating flow channel through damper 14 and an equivalent amount of ambient external air may be induced into the circulating flow channel through damper 15. Whether or not the air flowing through the circulating flow channel comprises recirculated mechanically-cooled air or comprises circulated cold ambient external air is controlled by an automatic control means (not shown) which automatically opens and closes dampers 14 and 15 and correspondingly closes and opens a third damper 16 which is positioned in the circulating flow channel intermediate of dampers 14 and 15. Air is circulated through the circulating flow channel by means of a fan 17 located within refrigeration plant 13. A cooling coil 18 of a refrigeration unit (not shown) is positioned in the circulating flow channel intermediate of damper 16 and the position where damper 15 allows air inflow.

As shown in FIG. 1, a perforated partition is located at each end of chamber 10 such that air flow through the circulating flow channel is generally evenly distributed across chamber 10. The upstream partition is designated as 20 in FIG. 1 and the downstream partition is designated as 21. The perforation size in the partitions increases with the separation distance from fan 17 to create the even air flow distribution. Also shown in FIG. 1 in outline are the rounded corners of the ice surface positioned above chamber 10. As previously mentioned, all of the surfaces of the circulating flow channel are insulated except for the ice rink slab which is thereby cooled to a temperature sufficiently low that the temperature of the ice resting thereon is maintained at the desired design temperature for skating, usually approximately 18° F. Such ice temperature is maintained by a control means which can modify the quantity of coolant in coil 18 and vary the rotational speed of fan 17. As mentioned previously, an ice temperature of 18° F. is a compromise between the power required of the refrigeration unit and an ice temperature sufficiently low to be suitable for skating. This assumes that the ambient external air is at too high a temperature to remove heat from the ice rink slab if circulated through the circulating flow channel; in such case, the dampers 14 and 15 are fully closed and all air in the circulating flow channe is air recirculated through damper 16 of the refrigeration plant. If, however, the ambient external air is at a temperature of approximately 16° F. or less, it is worthwhile to fully open dampers 14 and 15, to correspondingly fully close damper 16, and to turn off the refrigeration unit connected to cooling coil 18. In such case fan 17 will still continue to operate to induce ambient external air into the circulating flow channel at damper 15, move it through the path of the circulating flow channel, and expel it from the circulating flow channel at damper 14. Although the ice of the ice rink is cooled to only 18° F. when cooling coil 18 is utilized to remove heat from the circulating air, it should be clear that the ice can be cooled to temperatures lower than 18° F. if the ambient external air is instead utilized and is below approximately 16° F. In such case, the ice will attain a steady state condition at the reduced temperature and no futher cooling will be necessary until the ice temperature has increased back to 18° F. Such "stored cooling" results in a further reduction in operating costs.

FIGS. 2 and 3 are cross-sectional end views of two embodiments of ice rink constructions utilizing the subject invention. The invention should, however, in no way be construed as limited by the embodiments to be described.

The ice rink construction of FIG. 2 is a row of parallel I-beams 30 supporting a series of braced floor sections 31 which carry a metal deck 32 and a poured concrete slab 33 thereabove. The metal deck and poured concrete overlay of the ice rink portion of the arena is generally of lighter construction than the remaining portion of the arena floor; this is clearly shown in FIG. 2. The braced floor sections 31 each have a bottom member 34 to which is secured panelling 35. Such construction creates chambers 36 under the floor of the arena, each chamber 36 extending longitudinally in the arena between neighboring pairs of I-beams 30. Insulation 37 extends along the lower surface of the chambers 36 and also extends up the surface of the I-beams that are positioned under the sideboards of the ice rink. The chamber 36 that is located unde the non-ice rink portion of the floor of the arena and adjacent to the ice rink portion of the arena is insulated on its upper, lower and side surfaces so as to act as the insulated duct 12 which returns circulating air to the refrigeration plant. As shown in FIG. 2, spacers 38 are attached to the bottom member 34 of each floor support section 31 and also to the bottom of I-beams 30, the panelling 35 being secured to the bottom of the spacers 38. Insulation is placed on panelling 35 to the depth of the spacers 38. Also shown in FIG. 2 are the boards delineating the sides of the ice rink, the boards being designated as 39.

Figure 4:
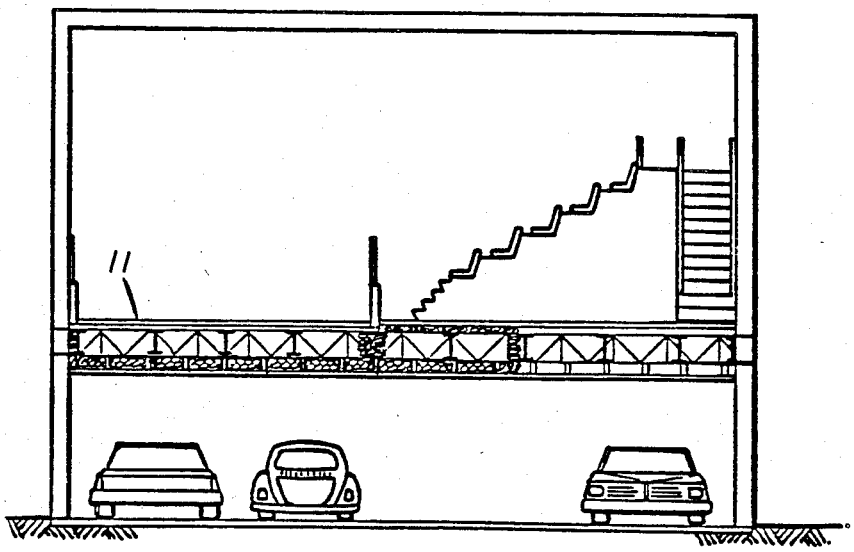
FIG. 4 (on the same page as FIG. 1) is a cross-sectional end view of a building utilizing the ice rink construction of FIG. 2.

The floor support construction of FIG. 2 is that utilized in FIG. 4. In FIG. 4 an ice rink arena has been shown in cross-section, a lower level of the arena housing a parking garage and the upper level housing an ice rink and the other arena facilities such as a viewing stand for the audience.

An alternate embodiment of an ice rink construction utilizing the subject invention is shown in FIG. 3. A series of parallel concrete block foundation walls 40 supports a floor 41 comprising a concrete slab on a metal deck. Positioned on the floor 41 directly above each concrete block wall 40 is an additional height of wall designated in FIG. 3 as 42. A floor 43, also comprising a concrete slab on a metal deck, rests on the upper block walls 42. As with the ice rink construction of FIG. 2, insulation extends along the bottom surface and side surfaces of the chamber immediately under the ice rink. Further, as with the construction of FIG. 2, the duct that carries return air to the refrigeration plant is insulated on all four of its sides. The air space 45 has a depth defined by the distance by which foundation walls 40 extend above the surface of the ground; that depth must be sufficient that ambient external air can freely circulate into the air space from either end of the arena. In this regard, it should be stressed that it is desirable during normal operation that no barriers be placed along the lower walls of the arena and that ambient external air be allowed access into the air space under the arena and adjacent to the ground.

With the embodiment of FIG. 3, it is possible to modify the subject invention by adding a retractable skirt to the lower wall of the arena to hinder or prevent access of ambient external air into the air space under the arena. In this embodiment the skirt assumes the retracted position during most of the year but is lowered during the spring to prevent the ambient external air from heating the ground below the arena. The ground under the arena then thaws at a slower rate by drawing heat from the interior of the arena. This can advantageously save a portion of the air conditioning costs normally encountered during the early months of summer.

FIGS. 2 and 3 are only two of the possible ice rink constructions in which the subject invention might be utilized. It should be clear to one skilled in ice rink construction that other structural arrangements could be utilized. For instance, steel plate supported on a space frame could be utilized in place of a concrete slab to support the ice surface; in such case, the ice thickness could be approximately double that in conventional ice rinks, thus providing another type of "stored cooling" and attendant reduced operating costs.

Figure 5:
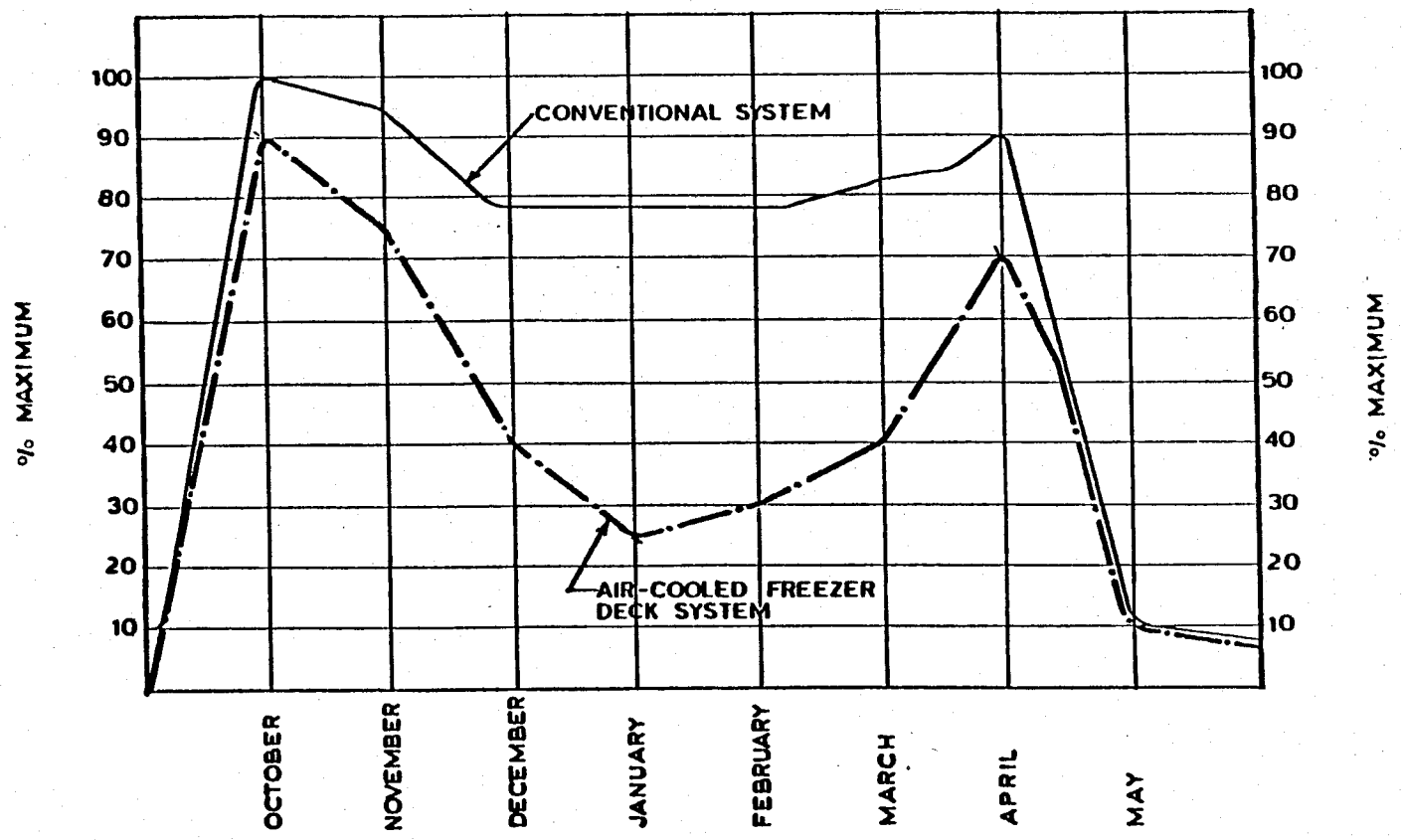
FIG. 5 is a graph comparing the power consumption in equivalent size ice rinks of a conventional Freon-brine cooling system with that of the air-cooled system of the subject invention.

FIG. 5 illustrates the estimated savings that may be effected in annual power consumption by utilizing the air-cooled freezer deck system of the subject invention rather than a conventional Freon-brine system. Maximum power consumption occurs during Oct., and it can be seen that the maximum power consumption of the cooling system of the subject invention is only 90% of that of the conventional system. During the mid-winter months the power consumption of the cooling system of the subject invention is dramatically lower than that of the conventional system due to two factors. The first factor is that ambient external air is utilized for ground cooling and the second factor is that ambient external air can be utilized in the circulating flow channel to reduce the operating cost of the refrigeration plant. For the same size ice rink surface, capital cost for installing the cooling system of the subject invention is similar to that for installing a conventional cooling system, but it should be evident from FIG. 5 that the lower power consumption of the cooling system of the subject invention will result in a correspondingly lower operating cost.

The subject invention is not restricted in its application to new ice rink construction only but is also applicable to existent ice rink structures having failed slabs. Such slabs need not necessarily be removed prior to installation of the cooling system of the subject invention, but can instead in certain cases be incorporated into that cooling system. If the old slab was mounted above an air cavity to which ambient external air can be given access, the old slab can be utilized as the base of an air flow chamber having a new slab as its cover. In this construction, the new ice surface would be approximately sixteen inches higher than the old ice surface which might necessitate removal of the front row of seating and raising of the sideboards, but the reduced operating costs should more than compensate for such renovations. If no air cavity exists under the old slab to which ambient external air can be given access, a new slab can still be positioned over the old slab to define an air flow chamber; in such case, the mid-winter power consumption will be greater than would be the case if an air cavity were present because in such case the cooling system rather than ambient external air cools the ground. As should be evident to one skilled in the art, in all cases of renovations or new construction, the ice surface would be structurally supported to bearing below frost.

I claim:

1. An ice rink comprising:

(a) a floor means having a top surface for supporting ice thereon;

(b) insulating means positioned beneath and substantially coextensive with said floor means;

(c) cooling means intermediate the top surface of said floor means and said insulating means;

(d) support means for supporting said floor means, said cooling means and said insulating means at a level above the ground sufficient to allow ambient air to circulate between such insulating means and the ground.

2. The ice rink of claim 1, wherein said insulating means comprises a bottom portion generally parallel to and spaced from said floor means and a peripheral wall portion generally surrounding said bottom portion and forming with said bottom portion and with said floor means a chamber extending under the floor means wherein all surfaces except the upper surface are insulated against heat transfer, said ice rink further comprising means for circulating cold air through the said chamber at a rate sufficient to maintain freezing of the ice on said floor means.

3. The ice rink construction of claim 2, wherein the means for circulating cold air through the chamber comprises:

(d) an insulated duct means having one end connected to one end of the chamber and another end connected to the other end of the chamber, so as to define with the chamber a circulating flow channel;

(e) a fan means to circulate the air through the circulating flow channel; and (f) a cooling means to cool the air being circulated through the circulating flow channel.

4. The ice rink construction of claim 3, wherein the means for circulating cold air through the chamber additionally comprises:

(g) means to introduce ambient external air into the circulating flow channel;

(h) means to expel a corresponding amount of air from the circulating flow channel; and (i) means to selectively control the relative proportion of ambient external air introduced into the circulating flow channel to the total amount of air being circulated through the circulating flow channel.

5. The ice rink construction of claim 4, wherein the means to introduce air into and expel air from the circulating flow channel is a pair of first dampers spaced from each other along the circulating flow channel, and the selective control means is a means of operating the pair of first dampers and a second damper positioned in the circulating flow channel intermediate of the pair of first dampers to control flow past that position in the circulating flow channel.

6. The ice rink construction of claim 3, wherein the insulated duct means is generally located in the same horizontal plane as the chamber.

7. The ice rink of claim 1 wherein said support means comprises spaced support members for allowing free access of ambient air into the space between said insulating means and the ground.

* * * * *